US011267023B2

(12) United States Patent
Dlutowski

(10) Patent No.: US 11,267,023 B2
(45) Date of Patent: Mar. 8, 2022

(54) HEARING DEVICE RESTORATION DEVICE, SYSTEM, AND METHODS THEREFOR

(71) Applicant: MedRx Inc., Largo, FL (US)

(72) Inventor: Jay Dlutowski, Largo, FL (US)

(73) Assignee: MedRx Inc., Largo, FL (US)

( * ) Notice: Subject to any disclaimer, the term of this patent is extended or adjusted under 35 U.S.C. 154(b) by 570 days.

(21) Appl. No.: 15/782,209

(22) Filed: Oct. 12, 2017

(65) Prior Publication Data

US 2018/0104725 A1 Apr. 19, 2018

(30) Foreign Application Priority Data

Oct. 13, 2016 (EP) ..... 16193682

(51) Int. Cl.

*B08B 5/04* (2006.01)
*H04R 1/12* (2006.01)
*H04R 25/00* (2006.01)

(52) U.S. Cl.

CPC ..... *B08B 5/04* (2013.01); *H04R 1/12* (2013.01); *H04R 25/30* (2013.01); *H04R 2460/17* (2013.01)

(58) Field of Classification Search

CPC ..... H04R 2460/17; A47L 5/24; A47L 9/02; B08B 5/04
USPC ..... 15/330, 405; 73/1.59
See application file for complete search history.

(56) References Cited

U.S. PATENT DOCUMENTS 5,555,601 A * 9/1996 Schultz ..... A47L 5/24 15/339
2008/0253579 A1* 10/2008 Cronin ..... H04R 25/30 381/60
2017/0282219 A1* 10/2017 Kloepfer ..... B05B 7/32
2019/0133391 A1* 5/2019 Khazaieli ..... D06F 58/203
2020/0046186 A1* 2/2020 Woodbury ..... A47L 9/104

FOREIGN PATENT DOCUMENTS

CN 104540064 A * 4/2015

OTHER PUBLICATIONS

Buck, "MedRx Ultra Vac—Operating Instructions," XP055359567, http://www.medrx-usa.com/website/media/PDFs/UV-I-MULVAC-4_Io.pdf, Jan. 30, 2012, 13 pages.

* cited by examiner

*Primary Examiner* — Bryan R Muller
(74) *Attorney, Agent, or Firm* — Birch, Stewart, Kolasch & Birch, LLP

(57) ABSTRACT

A hearing restoration system with a housing having a user interface, a pump, control circuitry, and at least one pneumatic port. The hearing restoration system comprises one or more pneumatic ports, which are connected fluidly to one or more tubes. Furthermore, the housing may have a vacuum chamber fluidly connected to the third pneumatic port. A control circuitry is configured to detect a mode of operation of the system based on a measurement of pressure or vacuum inside the hearing aid restoration apparatus.

14 Claims, 12 Drawing Sheets

HEARING DEVICE RESTORATION DEVICE, SYSTEM, AND METHODS THEREFOR

BACKGROUND

Hearing devices, such as hearing instruments, personal sound amplifiers, hearing aids, active ear plugs, and headsets contain electronics that may be adversely affected by moisture and debris. Hearing devices also contain inlet ports (e.g. sound inlets) that guide ambient sound to sensors, internal or external channels that convey sounds, and outlet ports (e.g. a receiver outlet) that output sound to for example an ear canal of a hearing device user. Such ports and channels are often small (in the order of 1 mm or less in a cross-sectional dimension), and may be susceptible to clogging or blocking by e.g. debris. Some hearing devices, especially hearing aids, are worn by users in the various regions of the auditory duct, such as the ear canal, and are thus exposed to secretions, such as cerumen, produced by the ear canal of a user wearing the hearing device. The exposure of the hearing device to cerumen and moisture can adversely affect the performance of the hearing device by damaging the electronics and clogging various ports and channels which for example guides the sound from the ambient environment into the ear canal of a user.

For purposes of this disclosure, hearing aids are discussed, but do not limit the scope of the disclosed embodiments to be used only with hearing aids. A hearing aid typically includes small openings, referred to here as ports, that are intended to allow sound to pass. An inlet port is typically exposed to the ambient environment to allow sounds to enter the hearing aid. Hearing aids may be custom fitted to a user based on that user's hearing deficit and output amplified sounds through an outlet port. The size and shape of such ports are typically small, in the order of 1 mm or less, as small size is a desirable property of a hearing aid.

When a hearing aid is used, it is foreseeable that foreign substances, such as cerumen and other debris and moisture may enter the inlet and outlet ports and possibly clog them. When an inlet port is clogged, ambient sound might get attenuated, reducing the overall performance of the hearing aid. Similarly, a clogged outlet port may attenuate sounds reaching the user. A hearing device, such as hearing aids may include various protection devices, such as cerumen filters or specially shaped port openings to minimize the problem of cerumen and debris clogging.

It is desirable to provide the ability to clean and restore a hearing device to an improved state where the electronics and the inlet and outlet ports together with any channels are clean. Devices which are suitable for such purposes, such as hearing restoration devices and systems, provide cleaning and restoration capability, by providing a wand with a fine tip that enables a user to vacuum-clean the interior of a hearing device by inserting the tip directly into the various ports of the hearing device while suction is applied by the tip. The flow of air can be reversed and the wand can output pressurized air through the tip to help dislodge debris in the hearing device. Additionally, such devices may have a vacuum chamber into which a hearing device can be placed. When a hearing device is exposed to a vacuum for a predetermined period of time, moisture and debris is easily extracted from the device.

However, such systems require a complex configuration of electronic valves that increase its manufacturing complexity, manufacturing cost, and weigh. Moreover, such devices rely on a tube, which connects the wand to the pump, which tube may become soiled with debris extracted out of a hearing device when the wand is used as a vacuum cleaner, and this debris can then be expelled from the wand when the wand is used to supply pressurized air. This could adversely affect the cleaning of a hearing device, due to a potential cross-contamination.

Therefore, there is a need to provide a solution that addresses at least some of the above-mentioned problems. Accordingly, the present disclosure describes a device, system and methods that address at least some of these challenges and also provide other advantages.

SUMMARY

According to an embodiment of the disclosed subject matter, a hearing device or hearing aid restoration apparatus provides the ability to restore a hearing aid by removing clogging and moisture from the hearing aid. The term apparatus may be interchanged with system based on the context of the specification. According to other embodiments of the disclosure, a hearing aid restoration method provides the ability to restore the hearing aid. In an embodiment, restoration of a hearing device should be understood as the removal of debris and moisture and also de-clogging the internal ports and channels of the hearing device.

According to an exemplary embodiment of the disclosed subject matter, which may be combined with any of the foregoing and following exemplary embodiments, a hearing aid restoration apparatus may include a housing with at least a first pneumatic port that selectively outputs air and a second pneumatic port that selectively sucks in air. The selective outputting of air by the first pneumatic port may include periods of air being output when a pump is operating, and periods where no air is output when the pump is not operating. The first pneumatic port may be referred to herein as compressed air pneumatic port. The hearing aid restoration apparatus may also include a user interface that receives a user input to select a mode of operation of the hearing aid restoration apparatus, a first mode of operation providing no suction at the second pneumatic port and a second mode of operation providing suction at the second pneumatic port; and a controller that detects what mode of operation is selected based on a measurement of pressure (or vacuum, which is a measurement of negative pressure) inside the hearing aid restoration apparatus. The discussion of pressure and vacuum can be interchanged herein, with the understanding that measuring vacuum is the measurement of negative pressure.

According to an exemplary embodiment of the disclosed subject matter, which may be combined with any of the foregoing and following exemplary embodiments, the hearing aid restoration apparatus matter may include a vacuum sensor that measures a level of vacuum (or pressure) in an air space that is not fluidly connected to the second pneumatic port and outputs a signal representative of the measured level of vacuum to the controller. In embodiments, the air space can be a sealed or air-tight container of air. In embodiments, the air space may be a tube connected to a valve, such as pneumatic valve with multiple ports.

According to an exemplary embodiment of the disclosed subject matter, which may be combined with any of the foregoing and following exemplary embodiments, the hearing aid restoration apparatus may include a pneumatic valve that includes at least an input port, a first output port, and a second output port. The input port may be connected to the air space of the embodiment noted above. The hearing aid restoration apparatus may also include a pump that includes a pump inlet port and a pump outlet port, wherein the input port of the valve may be fluidly connected to the pump inlet port, the second output port of the pneumatic valve may be fluidly connected to the second pneumatic port, and the pneumatic valve may toggle a fluid connection from the input port of the pneumatic valve to either the first output port or the second output port.

According to an exemplary embodiment of the disclosed subject matter, which may be combined with any of the foregoing and following exemplary embodiments, the hearing aid restoration apparatus may include a fluid connection between the first output port of the pneumatic valve and a vacuum chamber port of the hearing aid restoration apparatus, wherein the vacuum sensor may be configured to measure the level of vacuum in the fluid connection.

According to an exemplary embodiment of the disclosed subject matter, which may be combined with any of the foregoing and following exemplary embodiments, the hearing aid restoration apparatus may also include a pad located on an outer surface of the housing and a removable container forming an airtight seal when placed on the pad, wherein the vacuum chamber port may be located at least partially in the pad. In an embodiment, the vacuum chamber port may have a filter element inserted therein.

According to an exemplary embodiment of the disclosed subject matter, which may be combined with any of the foregoing and following exemplary embodiments, the user interface can be configured as a toggle switch protruding from the housing, the toggle switch being movable between a first position corresponding to the first mode and a second position corresponding to the second mode. The toggle switch may control an internal flow path of the pneumatic valve.

According to an exemplary embodiment of the disclosed subject matter, which may be combined with any of the foregoing and following exemplary embodiments, the hearing aid restoration apparatus may include a vacuum cleaning wand (or simply "vacuum wand") fluidly connected to the second pneumatic port, the vacuum cleaning wand including a filter element, a tubular neck extending from the filter element, and a tip attached to an end of the tubular neck.

According to an exemplary embodiment of the disclosed subject matter, which may be combined with any of the foregoing and following exemplary embodiments, the vacuum wand of the hearing aid restoration apparatus may include a tubular shaped filter housing body enclosing the filter element enclosed on two ends with end caps. The vacuum wand may also include a pulsation element fluidly connected between the second pneumatic port and the filter housing body, the pulsation element selectively interrupting suction through the filter housing body at a regular interval.

According to an exemplary embodiment of the disclosed subject matter, which may be combined with any of the foregoing and following exemplary embodiments, the pulsation element may include a pulsation chamber that is a hollow cavity with an inlet port and an outlet port, with a piston with a piston head selectively closing the inlet port. A biasing device may exert a biasing force on the piston head to close the inlet port. When suction is applied to the outlet port, vacuum may build up in the pulsation chamber and exert a vacuum force on the piston head against the biasing force of the biasing device until the vacuum force overcomes the biasing force to open the inlet port until the biasing force overcomes vacuum force. When the biasing force overcomes the vacuum force, the piston head may close the inlet port again to repeat this cycle, which may cause a pulsating effect in the vacuum cleaning wand.

According to an exemplary embodiment of the disclosed subject matter, which may be combined with any of the foregoing and following exemplary embodiments, the pulsation element may include a bypass port providing a fluid connection from the inlet port of the pulsation chamber to the outlet port of the pulsation chamber through a pulsation control valve. The pulsation element may also include the pulsation control valve opening and closing the bypass port in response to a user's manipulation of the pulsation control valve to selectively enable and disable pulsation of the vacuum in the vacuum cleaning wand.

According to an exemplary embodiment of the disclosed subject matter, which may be combined with any of the foregoing and following exemplary embodiments, the hearing aid restoration apparatus may include an electronic valve interposed between the second pneumatic port and the vacuum cleaning wand and receiving a control signal from the controller, wherein the electronic valve may repeatedly open and close the fluid connection between the second pneumatic port and the vacuum cleaning wand in response to a command from the controller.

According to an exemplary embodiment of the disclosed subject matter, which may be combined with any of the foregoing and following exemplary embodiments, the housing of the hearing aid restoration system may include at least one storage compartment.

According to an exemplary embodiment of the disclosed subject matter, which may be combined with any of the foregoing and following exemplary embodiments, the at least one storage compartment may include an elongate recess in an upper surface of the housing According to an exemplary embodiment of the disclosed subject matter, which may be combined with any of the foregoing and following exemplary embodiments, the at least one storage compartment comprises a drawer extendable horizontally from the housing.

According to an exemplary embodiment of the disclosed subject matter, which may be combined with any of the foregoing and following exemplary embodiments, the hearing aid restoration apparatus may include a retracting mechanism that may extend and retract a tube, the tube passing through the second pneumatic port, the retracting mechanism at least partially spooling the tube inside the housing of the hearing aid restoration apparatus.

According to an exemplary embodiment of the disclosed subject matter, which may be combined with any of the foregoing and following exemplary embodiments, the hearing aid restoration apparatus may include a hearing aid placed within the removable container and above the vacuum chamber pad when the hearing aid restoration apparatus is in the first mode.

According to an exemplary embodiment of the disclosed subject matter, which may be combined with any of the foregoing and following exemplary embodiments, the controller may determine that the hearing aid restoration apparatus is in the second mode based on the vacuum sensor signal value being continuously at or below a predetermined threshold, and the controller may determine that the hearing aid restoration apparatus is in the first mode based on the vacuum sensor signal value fluctuating or being continuously above a second predetermined threshold.

According to an exemplary embodiment of the disclosed subject matter, which may be combined with any of the foregoing and following exemplary embodiments, the controller may initiate a count-down timer when it determines that the restoration apparatus is in the first mode, and the controller may turn off the pump at the expiration of the count-down timer.

According to an exemplary embodiment of the disclosed subject matter, which may be combined with any of the foregoing and following exemplary embodiments, the controller may output a message indicating an error condition on the display (by sending a command or signal or otherwise controlling the display) when the controller determines that the hearing aid restoration apparatus is in the first mode and the fluctuating vacuum sensor signal remains below a third predetermined threshold. This condition may be indicative of a leak in the vacuum chamber or the fluid connection from the vacuum chamber to the pneumatic valve, a leak in the pneumatic valve, or a leak in the connection between the pneumatic valve and the pump.

According to an exemplary embodiment of the disclosed subject matter, which may be combined with any of the foregoing and following exemplary embodiments, the controller may apply a ceiling function or a floor function to the vacuum sensor signal and may output a vacuum reading filtered by the ceiling function or the floor function on the display.

According to an exemplary embodiment of the disclosed subject matter, a method of restoring a hearing aid may include detecting by a controller whether a power switch of a hearing aid restoration apparatus has been activated, supplying electrical power to a pump in response to the power switch being activated, measuring a vacuum level in volume fluidly connected to a vacuum chamber with a vacuum sensor of the hearing aid restoration apparatus, determining that the hearing aid restoration apparatus is in a vacuum chamber mode when the measured vacuum level fluctuates or exceeds a predetermined threshold, and activating a timer in response to the determination that the hearing aid restoration apparatus is in the vacuum chamber mode.

According to an exemplary embodiment of the disclosed subject matter, which may be combined with any of the foregoing and following exemplary embodiments, the method may include monitoring the power switch and shutting off power to the pump when the power switch is turned off.

According to an exemplary embodiment of the disclosed subject matter, which may be combined with any of the foregoing and following exemplary embodiments, the method may include determining by the controller that the hearing aid restoration apparatus has been switched to a vacuum wand mode when the measured vacuum level drops below a second predetermined threshold after the determination that the hearing aid restoration apparatus is in the vacuum chamber mode and the pump is operating.

According to an exemplary embodiment of the disclosed subject matter, which may be combined with any of the foregoing and following exemplary embodiments, the method may include displaying a message indicating an error condition on a display of the hearing aid restoration device in response to a measurement of the vacuum level below a third predetermined threshold when the hearing aid restoration apparatus is in the vacuum chamber mode.

The disclosed hearing restoration system (also sometimes referred to as "the system" below) comprises a housing with a user interface, a pump, control circuitry (also referred to as a controller), and at least one pneumatic port. In an exemplary embodiment the hearing restoration system may comprise three pneumatic ports, with two of the pneumatic ports fluidly connected to a separate tube. One tube will be referred to as a pressure tube and the other tube as a suction tube. The housing may further comprise a removable container positioned on the third pneumatic port, referred to herein as a vacuum chamber port. The removable container may have an open cylinder shape, so that it forms a cup. When the cup is placed above the vacuum chamber port and suction is applied to the port, vacuum is created in the cup. This is will be referred to as a vacuum chamber.

The system may comprise a pump inside the housing. In an exemplary embodiment the pump may be a piston pump that is capable of generating 28.5 inHg vacuum. The pump has an inlet and an outlet which are connected to the various pneumatic ports to provide suction or pressure. The pump is driven by an electric motor that can be an internal part of the pump or can be a separate component that drives a driveshaft of the pump. An electrical switch positioned on the housing selectively provides power to the pump or provides a control signal to control circuitry that supplies power to the pump.

The outlet of the pump is fluidly connected, possibly through valves or a pressure storage tank, to one of the pneumatic ports, referred to as the compressed air pneumatic port or the first pneumatic port herein. When the pump operates it forces air through its outlet toward one of the pneumatic ports, or possibly to a pressure storage tank. Thus, compressed air is provided to the compressed air pneumatic port. The compressed air pneumatic port has an attachment interface that accepts a connection of a connector, such as a luer lock. The interface may be threaded or may include a flange.

A pressure tube is fluidly connected to the pneumatic port. The pressure tube is flexible yet resilient enough to withstand the pressure provided by the pump. A pressure wand is connected to the end of the pressure tube. The pressure wand includes an elongate body that is easy to grasp and hold by the user and terminates with a connector that can accept various attachments, such as tip elements, which are configured for insertion into e.g. inlet ports of a hearing device. The attachments can be connected safely to the connector with a luer lock, or other threaded or friction connections. A stream of pressurized air is emitted from the pressure wand through the attachments, and varying the size of the attachments can vary the speed of the air stream emitted from the pressure wand. The pressure tube and the pressure wand are separate from a suction tube and a suction wand that are attached to another pneumatic port.

The inlet of the pump provides air to the pump. Thus, when the pump is operating, air is sucked into the inlet of the pump, allowing the generation of a vacuum or partial vacuum in a closed space that is fluidly connected to the inlet of the pump. The inlet of the pump is connected via an internal suction tube to a pneumatic switch. The pneumatic switch can be manually operated or electrically operated. The pneumatic switch has multiple ports which are connected or disconnected depending on the state of the switch.

In one example, the pneumatic switch has three ports. Port one is fluidly connected to the inlet of the pump and alternatively connected to port two or to port three, depending on the switching state of the switch. In the case of a manually operated switch, a lever or push-bar extending from the switch toggles between the two connections. The pneumatic switch enables the inlet of the pump to be alternatively connected to either the vacuum pneumatic port on the housing or to the vacuum chamber port of the vacuum chamber.

The vacuum pneumatic port on the housing has an interface, much like the compressed air pneumatic port, that allows the suction tube to connect to the vacuum pneumatic port. One end of the suction tube is connected to the vacuum pneumatic port and the other end of the suction tube is connected to vacuum cleaning wand. The provision of a separate suction wand and pressure wand makes it easier to use the restoration system, as the user does not need to move a tube from one pneumatic port to another. Instead, the vacuum cleaning wand and the pressure wand are continuously available for the user.

Another advantage of providing separate wands and tubes is reduction of possible cross contamination. The vacuum cleaning wand may accumulate debris over time as it is used to extract debris from hearing devices. The wand is expected to be regularly cleaned, but nevertheless, debris could remain. If this tube were to be used in a dual-role as the pressure wand, the accumulated debris could clog the tip or blow into a hearing device that is being cleaned by the compressed air emitted from the wand.

The vacuum cleaning wand comprises a body that may comprise a cylindrical hollow housing body enclosed on both ends by end caps. The word cylindrical in this context does not necessarily require a circular cross-section, but can be any shape that has a hollow cavity in the interior and can be enclosed on two ends. The hollow cavity may hold a filtration element traps debris that is sucked into the wand by the suction of the pump. The vacuum cleaning wand may also comprise a tubular shaped neck extending from one of the end caps. The placement of the filter in the vacuum cleaning wand itself reduces or eliminates debris contamination of the suction tube that could, over time, reduce the overall suction performance of the restoration system.

The neck of the vacuum cleaning wand has an interface that accepts different vacuum cleaning tips sized to fit into various ports of a hearing device.

The system further includes a pressure sensor (also referred to as a vacuum sensor herein) fluidly connected to the vacuum chamber. The pressure sensor detects the level of pressure, or vacuum, in the vacuum chamber. By sensing the presence or absence of vacuum in the pressure chamber, the pressure sensor enables the microcontroller to determine the switching state of the pneumatic switch. If the pneumatic switch is in the state that connects the vacuum cleaning wand to the inlet of the pump, the pressure sensor will not register any vacuum. If the pneumatic switch is in the state that connects the vacuum chamber to the inlet of the pump, the pressure switch may register a vacuum of a predetermined magnitude.

The signal from the pressure sensor may be noisy or otherwise fluctuating. In an embodiment, the signal is subjected to low-pass filtering to smooth out the signal. Regardless of the filtering, the signal may be below the predetermined magnitude, suggesting a leak in the vacuum chamber or a malfunction of the pump. The signal may also fluctuate, indicating a leak or improper placement of the removable container above the vacuum chamber port. Even if the chamber is not properly sealed, the average value read from the vacuum sensor will be a higher vacuum than the case where the sensor is not connected to the pump (wand mode), thus allowing the microcontroller to detect the position of the switch.

The restoration system can also include a timer or implement a timer function in the microcontroller. The timer is activated to count down time during the vacuum chamber mode. It is desirable to limit the time that a hearing device is exposed to partial vacuum to avoid damaging delicate components, such as a receiver or microphone, by overexposure to vacuum. It is also desirable to enable the user of the restoration system to place the hearing device into the vacuum chamber and leave the system unsupervised to free up time for the user to attend to other tasks while the hearing device is being subjected to partial vacuum. The timer is activated in response to the signal from the pressure switch indicating that the system in in the vacuum chamber mode. The microcontroller can be programmed with custom settings for different users, including the duration of the timer.

The restoration system may comprise a user interface that includes a display that can present text and graphics to the user. The display may show the vacuum level in the vacuum chamber while the system runs in the vacuum chamber mode. The display can be programmed to vary its brightness and flash to indicate a problem condition, such as a leak in the vacuum chamber or a malfunction of the pump. The restoration system may also include an audible indicator, such as a buzzer, beeper, or a speaker, to output a sound as a notification to the user.

The hearing device restoration system is easy to use through a simple user interface that does not require extensive training. The system also includes a digital display to provide information to the user that is tailored to the operation performed by the system, and is customizable to address specific practices of particular users.

The system also includes a mechanically actuated switch to select two modes of vacuum operation—via a suction wand or via a vacuum chamber. The user does not need to understand or even think about the internal pneumatic configuration, and simply needs to move the switch into one of two possible positions. One position provides suction to the vacuum wand, and the other position provides suction to the vacuum chamber.

The system includes a sensor that outputs a signal that is used by the system to detect the mode (suction wand or vacuum chamber) of the system. This signal can then be processed through various signal processing algorithms to determine the mode of the system. The system includes a processor, such as a micro-controller or a field programmable gate array, that receives the signal from the sensor to determine the mode of operation. When the mode of operation is the vacuum chamber, the processor sets the timer described above and turns off the pump after a predetermined period of time.

BRIEF DESCRIPTION OF THE DRAWINGS

The disclosure may be best understood from the following detailed description taken in conjunction with the accompanying figures, which are incorporated herein and constitute part of this specification. The figures illustrate exemplary embodiments of the disclosure, and, together with the general description given above and the detailed description given below, serve to explain the features of embodiments of the disclosed subject matter. The accompanying drawings have not necessarily been drawn to scale. Where applicable, some features may not be illustrated to assist in the description of underlying features. The figures are schematic and simplified for clarity, and they just show details to improve the understanding of the claims, while other details are left out. The individual features of each aspect may each be combined with any or all features of the other aspects. These and other aspects, features and/or technical effect will be apparent from and elucidated with reference to the illustrations described hereinafter in which:

Embodiments will hereinafter be described in detail below with reference to the accompanying drawings, wherein like reference numerals represent like elements.

DETAILED DESCRIPTION

The description set forth below in connection with the appended drawings is intended as a description of various embodiments of the invention and is not intended to represent the only embodiments in which the invention may be practiced. The detailed description includes specific details for the purpose of providing a thorough understanding of the invention. However, it will be apparent to those skilled in the art that the invention may be practiced without these specific details. In some instances, well known structures and components are shown in block diagram form in order to avoid obscuring the concepts of the invention.

Figure 1A:
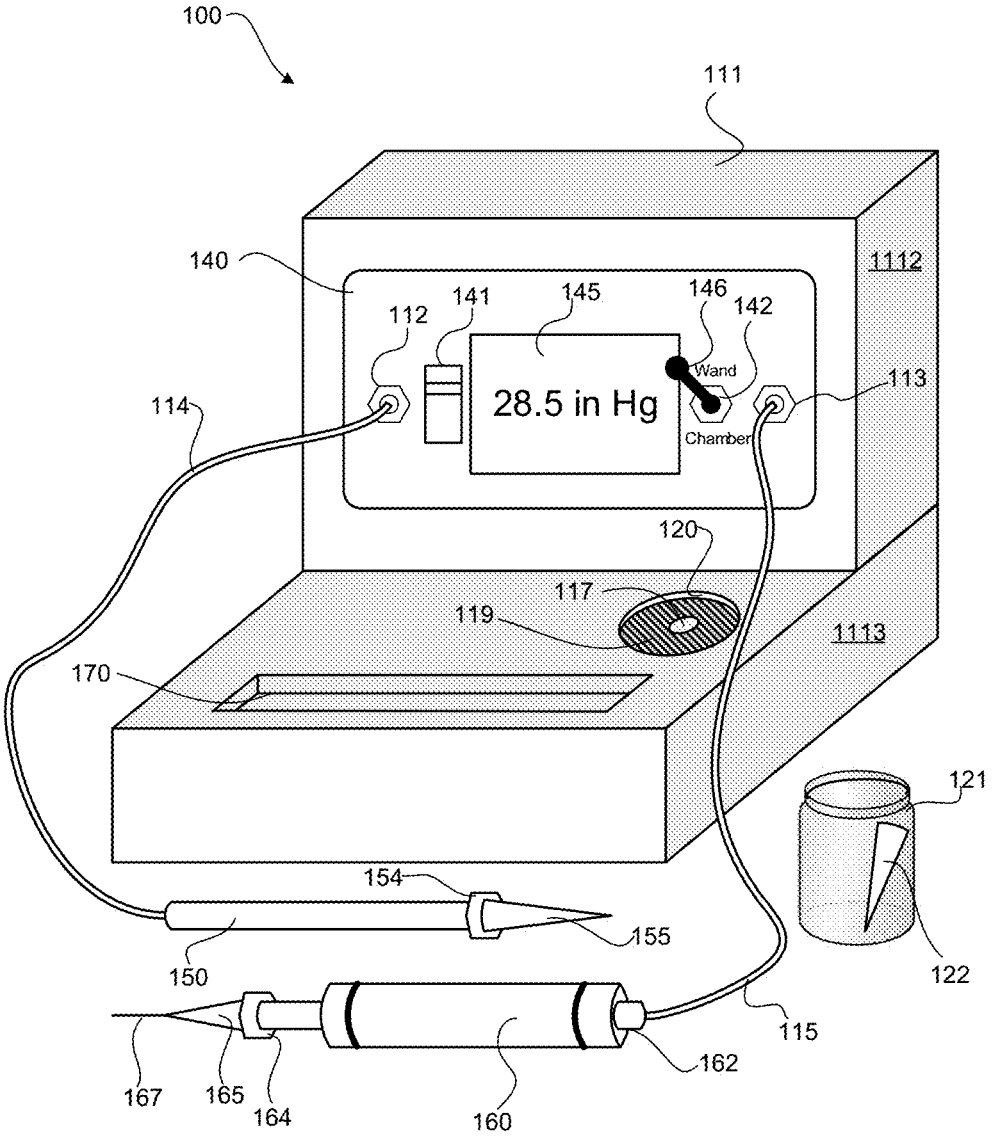
FIG. 1A illustrates an embodiment of a hearing aid restoration system.

A hearing device restoration system, such as a hearing aid restoration system 100 (also referred to as a restoration system or a restoration apparatus) according to embodiments of the disclosure provides the ability for an operator of the system to clean out debris from a hearing aid and to dry the hearing aid. Referring to FIG. 1A, illustrating an embodiment, the hearing aid restoration system 100 includes a housing 111. The housing 111 may be made of a polymer, a metal alloy, or any other rigid material that can contain the internal components. In embodiments, the housing 111 is made of a plastic, such as a thermoplastic.

Figure 1B:
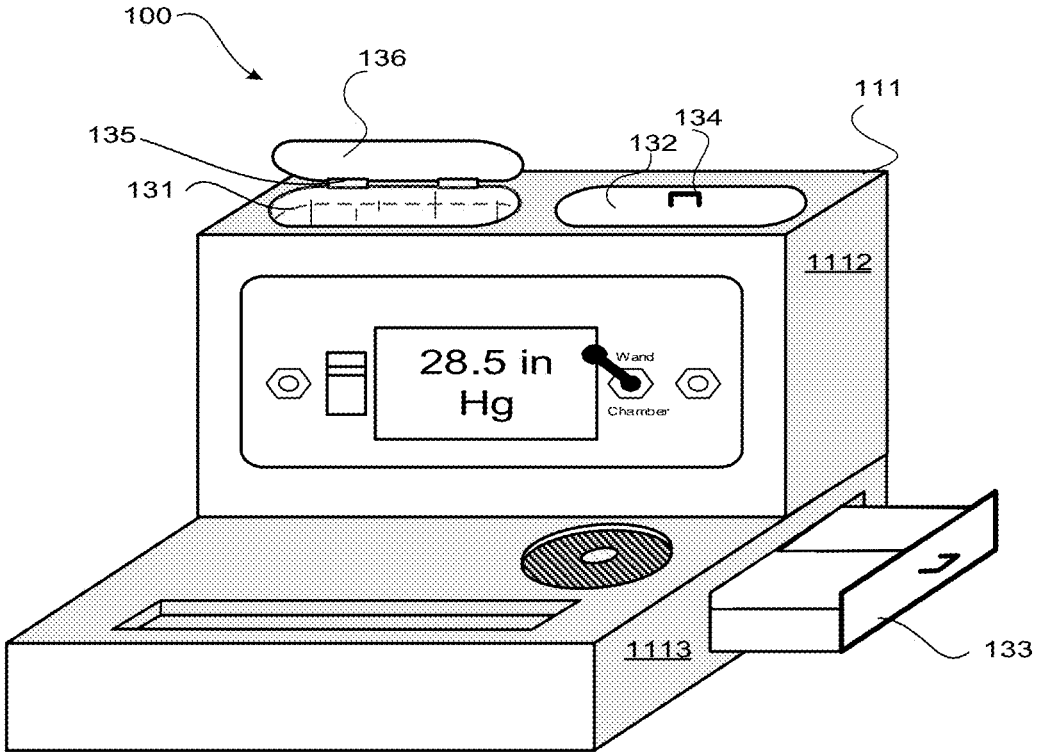
FIG. 1B illustrates another embodiment of the hearing aid restoration system with storage compartments in the housing.

In embodiments, the housing has a lower portion 1113 and an upper portion 1112, as illustrated in FIGS. 1A and 1B. The lower portion 1113 has an upper surface facing upward when the restoration system 100 in normal use. A wand tray 170 is in the embodiment shown recessed into the upper surface of lower portion 1113, and can be used to store the pressure wand 150 and the vacuum wand 160 when the wands are not in use. It should be noted that the hearing aid restoration system could be made without such wand tray and that the wand tray provides a storage option for the wand.

A part of the upper surface of the lower portion 1113 forms the base for a vacuum chamber formed when a removable container 121 is placed on top of vacuum chamber pad 119, and vacuum is generated inside the removable container 121. The removable container 121 can be used to store spare tips 122 for the pressure wand 150 and for the vacuum wand 160.

The vacuum chamber pad 119 is recessed into the upper surface of the lower portion 1113, thus providing an easy to recognize boundary of the vacuum chamber pad 119. The vacuum chamber pad 119 is bounded by a raised wall 120, which helps guide the removable container 121 onto the vacuum chamber pad 119. The raised wall also helps ensure that the user does not accidentally slide the removable container 121 from the vacuum chamber pad 119 while vacuum is being generated in the vacuum chamber. Once vacuum is generated, the removable container 121 is held firmly on the vacuum chamber pad 119 by the vacuum.

Figure 6:
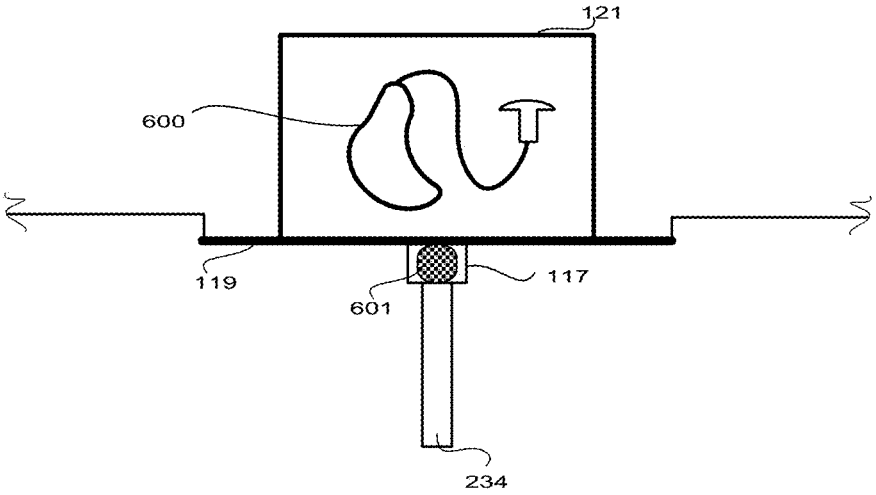
FIG. 6 illustrates a vacuum chamber according to an embodiment of the disclosure.

Referring to FIG. 6, vacuum chamber tube 234 is connected to vacuum chamber port 117 in the approximate center of the vacuum chamber pad 119. However, the vacuum chamber port 117 need not be in the center, but can be at any location that is covered by the removable container 121 when it is placed on the vacuum chamber pad 119. A vacuum chamber filter 601 is positioned in the vacuum chamber port 117 and filters air that is sucked out of the vacuum chamber to prevent or reduce fouling of the vacuum chamber tube 234.

A hearing aid 600 is placed in the vacuum chamber to thoroughly dry the hearing aid. After the hearing aid 600 is placed in the vacuum chamber, the removable container 121 is placed on top of the vacuum chamber pad 119 and vacuum is applied to the vacuum chamber. To apply the vacuum, the restoration system 100 is switched into the vacuum chamber mode (i.e., a first mode) by toggling pneumatic valve 142 into a particular position with the restoration system 100 powered on via the power switch 141. The power switch 141 can be an electrical toggle switch that has two positions. It can also be a momentary-on switch that is pressed in or down, or functions like a toggle switch that is biased into one position.

Referring back to FIG. 1A, the pneumatic valve 142 (also referred herein as a pressure switch) can have the appearance of a toggle switch 146 protruding from the face plate 140 of the housing 111. In an embodiment, the face plate 140 is attached to the upper portion 1112 of the housing 111. The pneumatic valve 142 can be toggled between the vacuum chamber mode noted above, indicated as "chamber" in the drawings, and a vacuum wand mode (i.e., a second mode), indicated as "wand" in the drawings. The moving of the toggle switch 146 from one position to another position may reconfigure the internal flow path through the pneumatic valve 142.

In an embodiment, the vacuum chamber mode is selected when the toggle switch 146 of pneumatic valve 142 is flipped down toward the lower portion 1113, while the vacuum wand mode is selected when the toggle switch 146 is flipped up. This orientation of the toggle switch 146 is advantageous for the users of the restoration system 100. When the vacuum chamber mode is selected (and the toggle switch is flipped down), the removable container 121 is firmly attached to the vacuum chamber pad 119 while vacuum is being generated in the vacuum chamber. The vacuum chamber mode is typically used for a period of several minutes, such as between 1 and 10 minutes.

In an embodiment, the restoration system 100 sets a timer at the beginning of the vacuum chamber mode and automatically stops supplying vacuum at the expiration of the timer. A user will then want to open the vacuum chamber, but even when the system is powered down, the vacuum will persist for some time in the vacuum chamber. To release the vacuum in the vacuum chamber, the toggle switch 146 is flipped up to the "wand" setting, which releases the vacuum in the vacuum chamber and makes it possible to lift up the removable container 121. A movement up of the toggle switch is advantageous for the user as it mimics the intended movement of the removable container 121, making it easy for the user to remember how to release the removable container 121 from the vacuum chamber pad 119.

Referring back to FIG. 1A, the upper portion 1112 of the housing 111 has a face plate 140 that contains a first pneumatic port (also referred to as compressed air pneumatic port 112), and a second pneumatic port (also referred to as vacuum pneumatic port 113). The ports 112 and 113 may be disposed toward the outer horizontal edges of face plate 140, with power switch 141, display 145, and the toggle switch 146 disposed between the ports 112 and 113.

The compressed air pneumatic port 112 may include a connection mechanism that allows pressure tube 114 to be fluidly connected to the port. The connection mechanism may be a quick-release type mechanism, a luer lock, a threaded pipe, or any other type of pneumatic connection. Similarly, the vacuum pneumatic port 113 may include such a connection mechanism to allow a fluid connection of suction tube 115 to the port.

The face plate 140 also includes the display 145 that displays various information about the operation of the restoration system 100. In an embodiment, the display 145 is a digital display, and may include a liquid crystal element that changes its appearance in response to the application of electrical current. The display 145 may also include an array of light emitting diodes that are individually controllable to emit light in a pattern that is recognizable as human readable characters or to graphically indicate the level of vacuum (LED bar graph). In an embodiment, the display 145 may include a back-light providing illumination for the information on the display 145. The back-light emits light at varying intensities and can cause the display to flash and get the user's attention. In an embodiment, the display 145 flashes when an error condition is detected. In this situation, the display 145 may also display text or graphics to inform the user of the error condition.

In an embodiment, the error condition is the lack of vacuum in the vacuum chamber. When the restoration system 100 operates in the vacuum chamber mode, but the level of vacuum in the vacuum chamber is below an expected threshold, the display 145 flashes with varying intensity of light to attract the user's attention, and also displays a message about a possible problem with the vacuum chamber.

Figure 7:
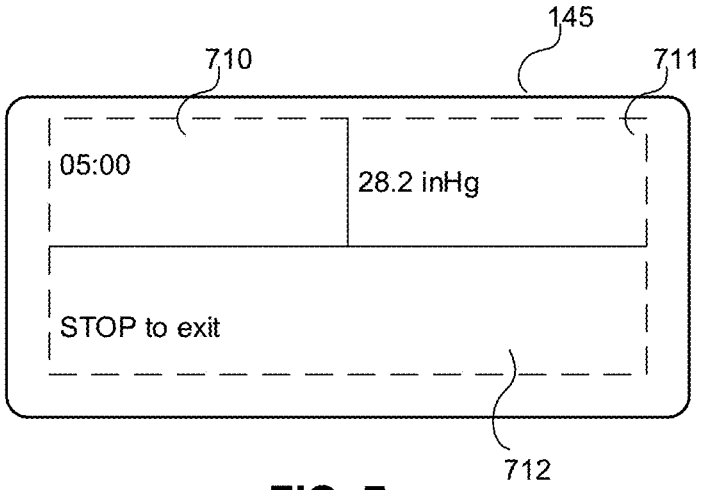
FIG. 7 illustrates a user interface of an embodiment of the disclosure.

Referring to FIG. 7, the display 145 may be divided into multiple distinct regions, with each region displaying different types of information. In an embodiment, the display 145 includes an upper left region 710, an upper right region 711, and a lower region 712. The upper left region 710 can display a count-down timer that indicates the duration of the vacuum chamber mode. The count-down timer may display minutes and seconds, as shown in FIG. 7. The upper left region 710 can also display an incrementing timer that indicates the duration of the operation of the restoration system 100, akin to an odometer of a car. The upper left region 710 may, thus, be used to determine when periodic maintenance should be performed on the restoration system 100.

The upper right region 711 can display a reading of vacuum detected in the vacuum chamber. The vacuum can be displayed in various units, such as inches of mercury (inHg), millimeters of mercury (mmHg), and similar. The display of the vacuum is based on a measurement by a vacuum sensor 230, sometimes also referred to as a pressure sensor, described further below. In an embodiment, the readout from the vacuum sensor 230 is not directly presented on the display 145, but is additionally processed by controller 210. As vacuum builds up in the vacuum chamber, the vacuum measurement by the vacuum sensor 230 may fluctuate. Such fluctuations of the measurement can be displayed on the display 145 or they may be filtered out by the controller 210.

As noted above, a leak may be present in the fluid connection from the pump 220 to the removable container 121 due to a leak in a tube, a leak in a fitting, a leak in the pneumatic valve 142, or leak or crack in the removable container 121, or an improper or incomplete placement of the removable container 121 on the vacuum chamber pad 119. In this situation, the reading from the vacuum sensor 230 will not be completely zero, but will instead fluctuate below some value. The controller 210 can detect this situation and call the operator's attention by displaying an error message on the display 145, flashing the display 145, or outputting other stimulus that the operator can perceive. In an embodiment, the display 145 may output instructions on how to correct or try to correct the error condition that is being detected by the controller 210.

In an embodiment, the controller 210 controls the display 145 to display the vacuum as 0 units for any measurement below 5 units of measured vacuum (e.g., 5 inHg), and increment to a reading of 5 units only after the actual measurement is above 5 units. This can continue in increments of 5 units, or any other unit size, until a predetermined threshold is reached. This type of processing can be thought of as a floor function or a ceiling function. In an embodiment, the predetermined threshold can be the measurement of vacuum at sea level (i.e., 28.5 inHg) or some value below the level of vacuum. This control of the display 145 avoids user confusion that could be caused if unexpected fluctuations of vacuum level were displayed on the display 145.

In an embodiment, display 145 further includes lower region 712 which can be larger than the two upper regions, or can itself be subdivided into further regions. In and embodiment, the lower region 712 can display text or graphics to convey a message to the user. The message may provide operating instructions on how to use the restoration system 100. For example, the lower region 712 may state that the toggle switch 146 needs to be toggled to the "wand" position at the conclusion of the vacuum chamber mode to open the vacuum chamber.

While the display 145 has been described above with regions 710, 711, and 712 in particular locations, those locations could be interchanged among the regions and fewer or more regions can be used. In an embodiment, the display 145 is implemented as a touch-sensitive screen that displays information and also receives input based on pressure change or capacitance change at a particular location on the display 145.

Referring to FIG. 1B, an embodiment of the restoration system 100 is illustrated that includes one or more storage compartments. The restoration system 100 includes housing 111 as shown in FIG. 1A, but the housing 111 may include storage compartments formed in the housing 111. In an embodiment, the upper portion 1112 includes one or more storage compartments. Storage compartment 131 is formed as a recess on the upper surface of the upper portion 1112 into the inner cavity of the housing 111. The storage compartment 131 may be opened at the top, or may include a door 136 attached to the upper portion 1112. In an embodiment, the door 136 is attached via a hinge 135 or a similar mechanism, such as a flap. The door 136 may include a handle 134, or a similar attachment such as an opening or a hole for a user's finger, to enable the user to easily open the door 136.

Though FIG. 1B illustrates an embodiment with two storage compartments (131 and 132), it is envisioned that a single storage compartment, or more than two storage compartments are provided to allow the user to store and sort accessories of the restoration system 100.

In an embodiment, the lower portion 1113 of the housing 111 includes a drawer 133 which extends sideways from the lower portion 1113. This embodiment can be combined with the storage compartments 131 and 132 in the upper portion 1112.

Figure 2A:
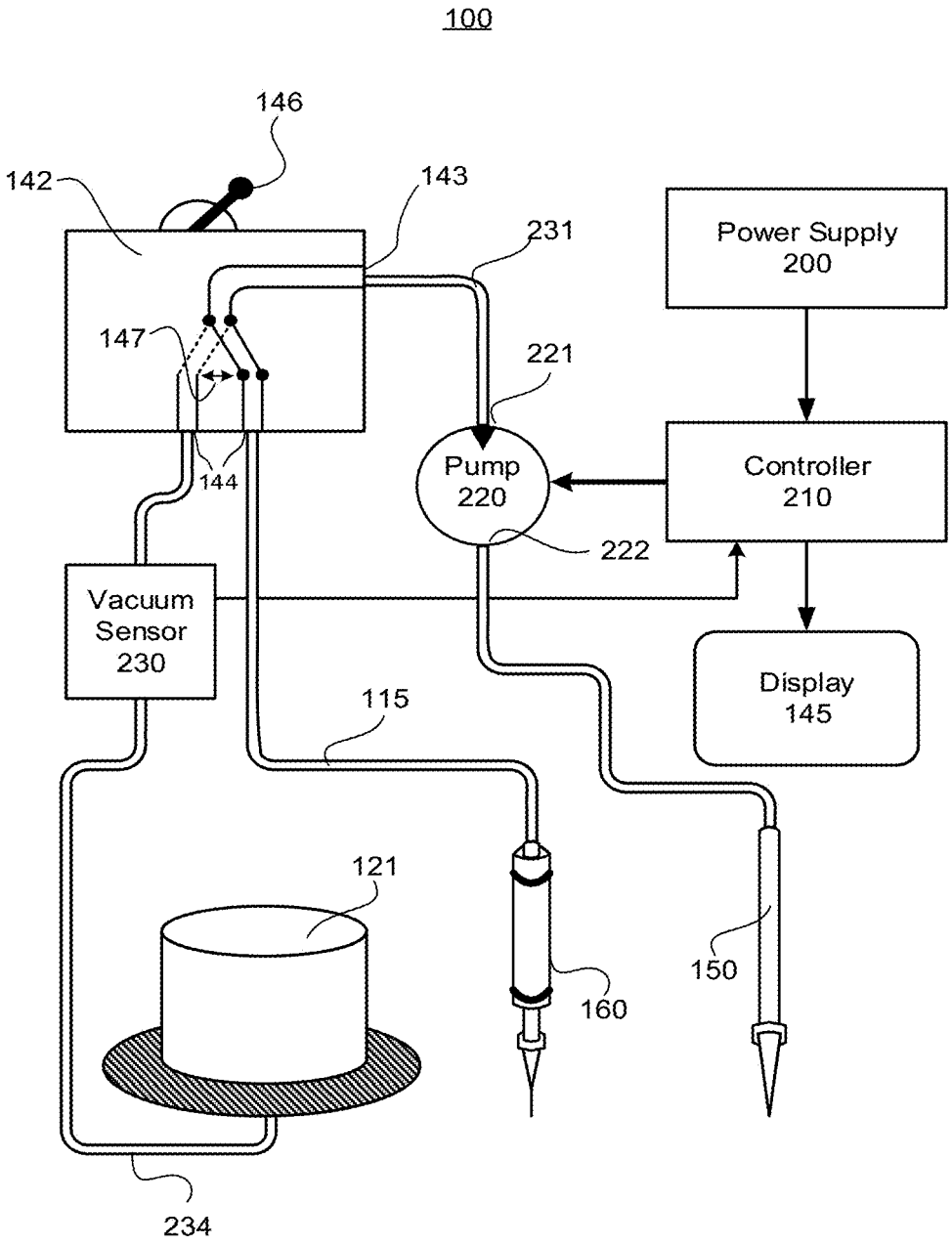
FIG. 2A illustrates pneumatic and electrical connections according to an embodiment.

Turning next to FIG. 2A, the internal pneumatic and electrical connections of an embodiment of the restoration system 100 are shown. A power supply 200 receives power either as alternating current (AC) or direct current (DC) when the power switch 141 is turned on.

In the case of AC, the power supply 200 can be powered by 100-240 V AC 50-60 Hz. In an embodiment, the power supply 200 contains a fuse to limit the current draw. A 1.25 Amp fuse can be used when 220-240 V is supplied and a 2.5 Amp fuse can be used when 100-112 V is supplied. When AC power is used, the AC voltage is converted in the power supply 200 to a lower DC voltage. In an embodiment, the DC voltage is 12 V at 5 Amps, and is supplied to the pump 220 via a relay that is controlled by the controller 210. The relay (not illustrated) can be a solid state relay. The power supply 200 also provides a lower DC voltage output to power the controller 210 itself. In an embodiment, the power supply 200 outputs 5 V DC and the controller 210 runs embedded code.

The controller 210 receives a signal output by the vacuum sensor 230 and provides a signal to the display 145. In an embodiment, the vacuum sensor 230 can read a vacuum relative to atmosphere up to 115 kPA (33 inHg).

In an embodiment, the controller 210 uses the output of the vacuum sensor 230 to determine what mode ("wand" or "chamber") the toggle switch 146 of the pneumatic valve 142 is in. The vacuum sensor 230 monitors the vacuum generated in the vacuum chamber formed by the removable container 121 positioned over the vacuum chamber pad 119. The vacuum sensor 230 is fluidly connected to an output port 144 of the pneumatic valve 142. The output port 144 may be divided into a first output port and a second output port, which are both connected to the pneumatic valve, but is configured to provide either a vacuum wand mode or a vacuum chamber mode, depending on mode of operation of the system.

In an embodiment, the pneumatic valve 142 is a 4-way toggle valve used to connect the suction port of the pump 220 to either the vacuum chamber or the vacuum wand 160. In an embodiment, the pneumatic valve 142 has a toggle switch 146 which can be moved between two positions. As shown schematically in FIGS. 2A-2C with double arrow 147, toggling the toggle switch 146 causes the internal flow through the pneumatic valve 142 to reconfigure, such that the valve input port 143 is fluidly connected to one or the other of the valve output ports 144, but not both at the same time. In one position (i.e., the first position), the pneumatic valve 142 connects valve input port 143 to the vacuum chamber tube 234 and the vacuum sensor 230. The effect of this position may be referred to herein as the first mode, the vacuum chamber mode, or simply chamber mode. In the other position (i.e., the second position), the pneumatic valve 142 connects the valve input port 143 to the suction tube 115 of the vacuum wand 160. The effect of this position may be referred to herein as the second mode, the vacuum wand mode, or simply the wand mode. In an embodiment, the pneumatic valve 142 is switched by turning, pulling, or pushing a knob or a handle rather than toggling a switch.

In an embodiment, the vacuum persists in the vacuum chamber even when the pump 220 is turned off when the pneumatic valve 142 is in the vacuum chamber mode due to one-way check valves in the pneumatic valve 142. As described above, when the pneumatic valve 142 is toggled into the vacuum wand mode, the vacuum in the vacuum chamber is released, and the removable container 121 can be lifted from the vacuum chamber pad 119.

The valve input port 143 of the pneumatic valve 142 is fluidly connected to the pump inlet port 221. The pump 220 pulls in air through the pump inlet port 221 and expels it through pump outlet port 222. In an embodiment, the pump 220 operates off of 12V DC, has a flow rate up to 6.5 l/min, runs at a nominal speed of 3100 rpm and its two diaphragm pump assemblies are configured in series.

The pump outlet port 222 is fluidly connected to the pressure wand 150 through the pressure tube 114. When the pump 220 operates, it generates pressure at the pump outlet port 222. This pressure causes air to be emitted from pressure wand tip 155. In an embodiment, the toggle switch 146 is toggled into the "wand" setting when the pressure wand 150 is used. In this mode, air is sucked in through the tip 165 of the vacuum wand 160 and air is expelled at pressure from the pressure wand tip 155. Tips 155 and 165 may be interchangeable such that tip 155 may be attached to the vacuum wand 160 while tip 165 may be attached to the pressure wand 150. The tips can be generally conically shaped with a hollow air passage in their core to allow air to pass through the tip. The end of the tip can be further terminated with a hollow needle 167. Tips of different sizes or with needles of different sizes (thickness) can be used for accessing various sizes of ports, inlets, or openings of a hearing aid when it is being restored.

In an embodiment, the controller 210 uses the output of the vacuum sensor 230 to determine what mode ("wand" or "chamber") the toggle switch 146 of the pneumatic valve 142 is in. When the pneumatic valve 142 is in the "wand" mode, there is no suction applied to the vacuum sensor 230 by the pump 220, and the vacuum sensor 230 will read a constant zero or near-zero value. The controller 210 can determine based on this value that the pneumatic valve 142 is in the "wand" mode, and will supply power to the pump 220 continuously.

On the other hand, when the pneumatic valve 142 is in the "vacuum chamber" mode, the pneumatic valve 142 fluidly connects the pump inlet port 221 of the pump 220 to the vacuum sensor 230. If the removable container 121 is not positioned at all, or not positioned correctly on the vacuum chamber pad 119, the vacuum sensor 230 will register a low value which may fluctuate. If the removable container 121 is correctly positioned on the vacuum chamber pad 119, the vacuum sensor 230 will read an increasing vacuum value. The controller 210 determines based on a detection of a low vacuum reading, but that is fluctuating, or a high vacuum reading, that the pneumatic valve 142 is in the "chamber" mode.

In an embodiment, when the controller 210 determines that the pneumatic valve 142 is in the chamber mode, it will set a count-down timer for the pump 220. In an embodiment, the time is set to 5 minutes, but can be set to a different value, such as 1 minute, 2 minutes, 3 minutes, 4 minutes, 6 minutes, 7 minutes and up. In an embodiment, the user can increase or decrease the time remaining while the pump is running or while it is paused. When the time expires, the controller 210 turns off power to the pump 220. In an embodiment, the controller 210 outputs a message on the display 145 indicating that the timer has expired. In an embodiment, the controller 210 causes the display 145 to flash and outputs an audible signal for the user.

The pneumatic valve 142 is more robust and reliable than electronically controlled valves, and when connected as disclosed herein, provides a simple configuration at a fraction of the cost of using multiple electronically controlled valves. Further, embodiments of the speed of the restoration system 100 with the pneumatic valve 142 are compact and free up space inside the housing 111 for storage compartments 131 and one or more drawers 133. In an embodiment, additionally or alternatively, the free space inside of housing 111 includes a retracting mechanism 250, as illustrated in FIG. 2B and described below.

Figure 2B:
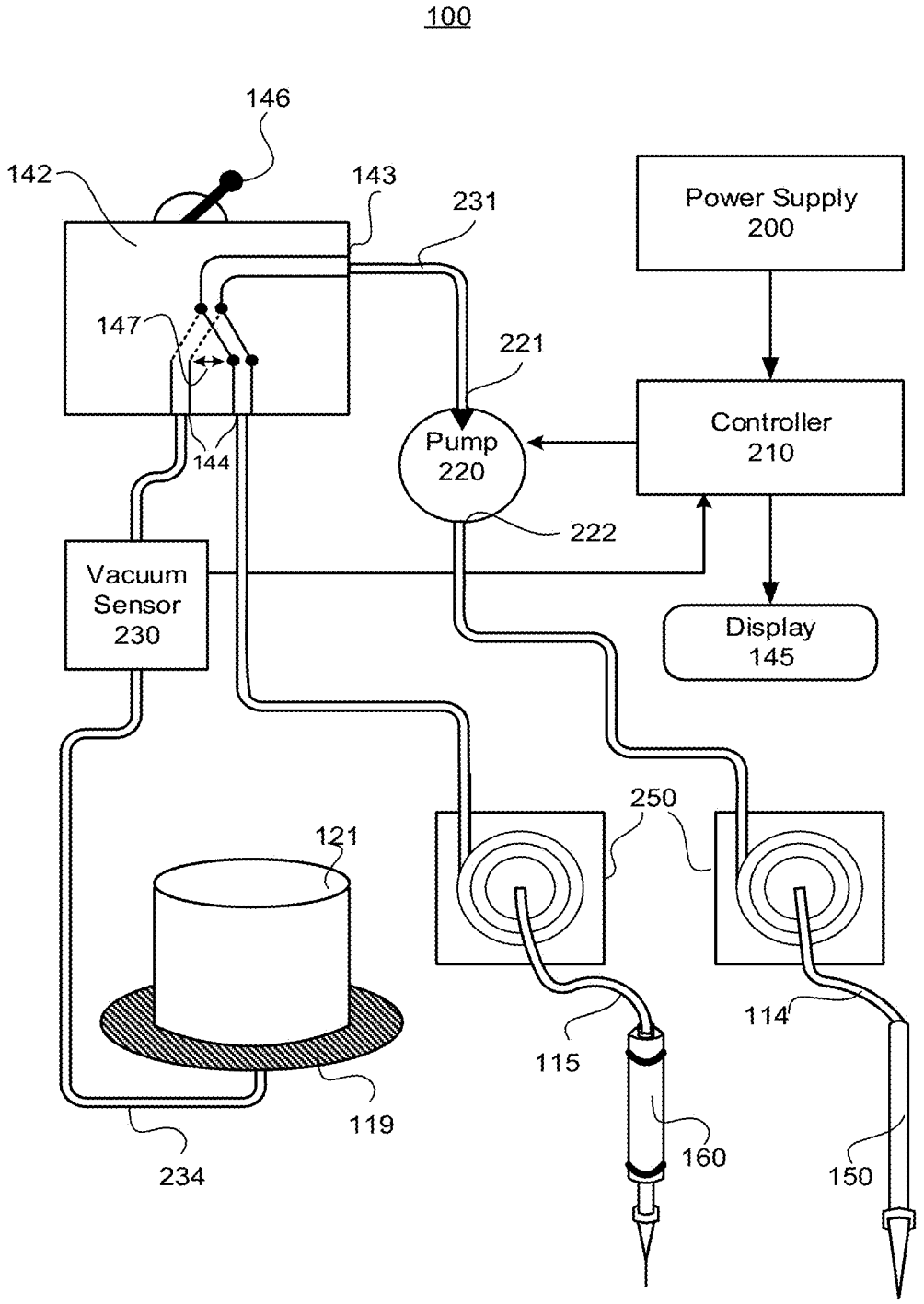
FIG. 2B illustrates pneumatic and electrical connections according to an embodiment of the restoration system with retractable cables.

Referring to FIG. 2B, an embodiment of the restoration system 100 includes a retracting mechanism 250 inside housing 111. Other elements in 2B are already described above with reference to FIG. 2A. The retracting mechanism 250 includes two separate spools of tubing, though a combined spindle can be used, with two reels on the same axle. The suction tube 115 of the vacuum wand 160 can be connected directly to one of the spools of the retracting mechanism 250, or may be detachably attached to connector that protrudes from the face plate 140 of the upper portion 1112. The pressure tube 114 of the pressure wand 150 may be similarly attached directly to a spool of the retracting mechanism 250, or may be attached to a connector on the face plate 140.

In an embodiment, the retracting mechanism 250 is spring powered and keeps the tubes in the extended position until a tube is pulled away from the retracting mechanism 250. Then, the retracting mechanism 250 relies on internal springs to rotate a spool and wind a tube onto the spool.

In an embodiment, the retracting mechanism 250 includes an electrical motor that is controlled by the controller 210. In this embodiment, the spools of the retracting mechanism 250 allow a user to exert a pulling force on tubes 115 and 114 to extend them out from the housing 111. Although a connection is not shown in FIG. 2B, the controller 210 controls the electrical motor (or multiple motors) of the retracting mechanism 250 to reel in the tubes. The controller 210 can issue a command to reel in the tubes in response to the power switch 141 being toggled to the off position, or in response to a different user command.

Figure 2C:
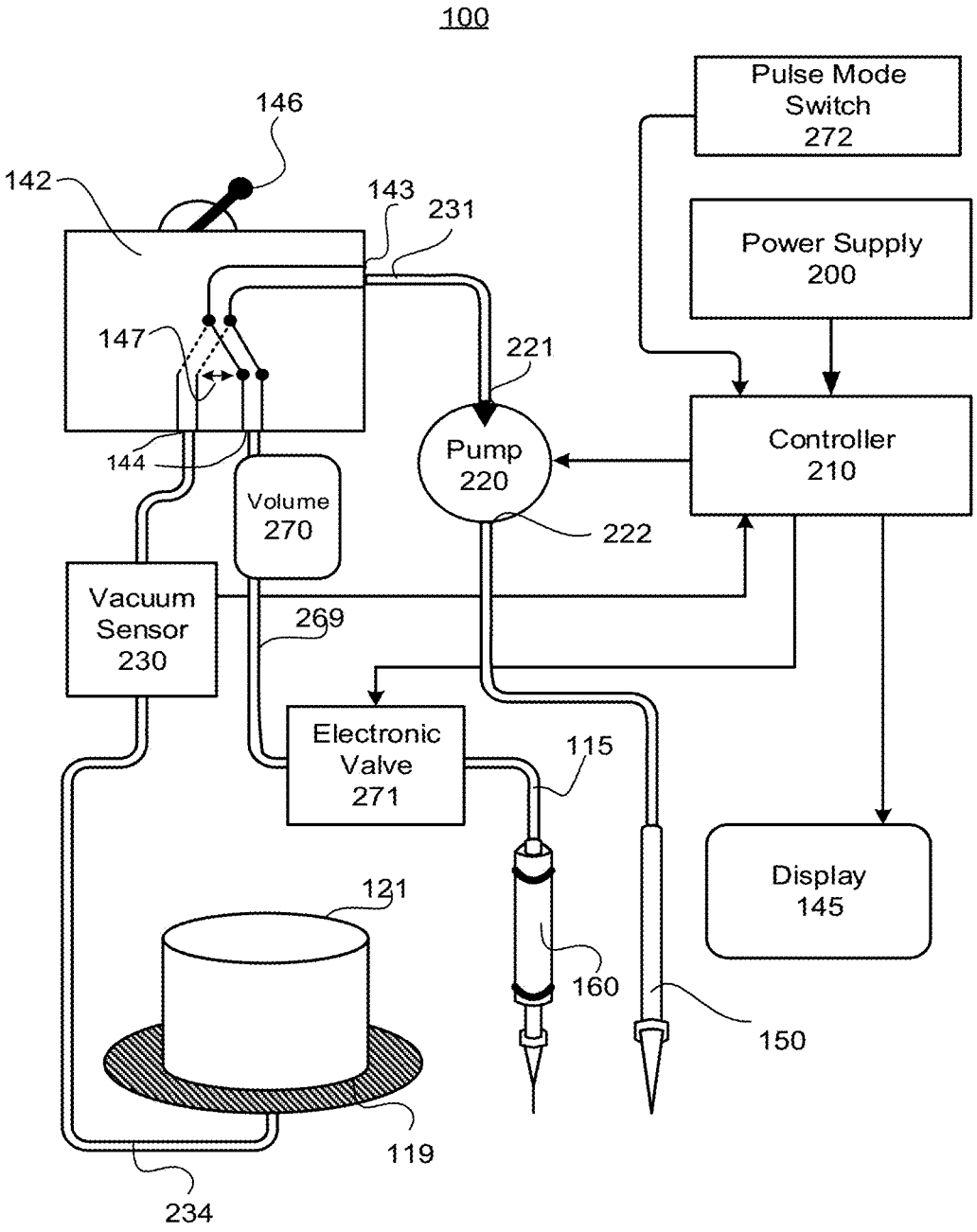
FIG. 2C illustrates pneumatic and electrical connections according to an embodiment of the restoration system with a pulsating vacuum suction.

Referring to FIG. 2C, an embodiment of the restoration system 100 includes pulsating vacuum functionality. In some cases, it may be advantageous to apply the suction from the vacuum wand 160 as pulses of suction alternated with pulses of no, or reduced, suction. This pulsation can dislodge stubbornly attached debris through a back-and-forth rocking of the debris. In an embodiment, the pulsation mode also exposes the debris to higher suction as vacuum builds up in a chamber with volume, shown as volume 270 in FIG. 2C.

An embodiment that provides the pulsating vacuum functionality includes an electronic valve 271 fluidly connected between an output port 144 of the pneumatic valve 142 and the suction tube 115 of the vacuum wand 160. In an embodiment, volume 270 is fluidly connected between the output port 144 and a port of the electronic valve 271, as shown in FIG. 2C. The volume 270 can be a sealed container with two ports, a sealed container with a single port connected to T-splice in tube 269, or even an extension of length of the tube 269 that provides volume in which vacuum can build up. In an embodiment, the size (e.g., in units of milliliters) of the volume 270 is set based on the rate at which the electronic valve 271 opens and closes and the flow and suction rate of the pump 220.

The electronic valve 271 opens and closes a fluid connection in response to a control signal from the controller 210. A pulse mode switch 272 is disposed on or in the housing 111 and controls the selection of the pulsed vacuum mode. The pulse mode switch 272 provides a signal to the controller 210, which in turn controls the opening and closing of the electronic valve 271. When the pulsed vacuum mode is not selected, the electronic valve 271 remains opened. When the pulsed vacuum mode is selected, the electronic valve 271 alternates quickly between an open state and a closed state. The cyclic rate of the electronic valve 271 can be controlled by the controller 210 up to the physical limit of the electronic valve 271. In an embodiment, the electronic valve 271 pulses open and closed ranging from once every 0.1 second to once every 2 seconds. In various embodiments, the cyclic rate is once every 0.1 second, once every 0.5 second, once every second, and once every 1.5 seconds. The pulsation functionality can also be achieved with a pulsation vacuum wand discussed below with reference to FIGS. 4A and 4B.

Figure 3A:
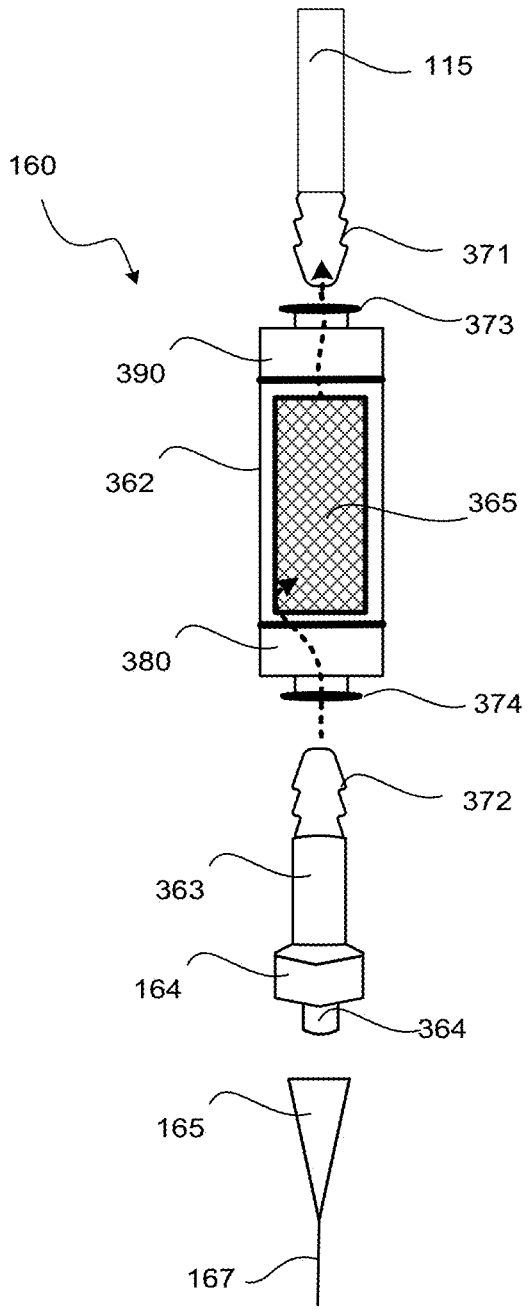
FIGS. 3A and 3B illustrate an embodiment of a vacuum wand of the restoration system.

FIG. 3A illustrates a vacuum wand 160 according to an embodiment. The suction tube 115 is terminated with a mating connector 371 that may include ribs or barbs for a secure connection with the flange 373 of the filter housing body 362. The flange 373 can be movable into and out of the filter housing end cap 390 to release the mating connector 371. The filter housing end cap 390 is detachably attached to the filter housing body 362. The attachment may be via a friction fit, a threaded connection, locking lugs, or other types of detachable connections.

The filter housing body 362 has a tubular shape, such as a hollow cylinder. However, the cross sectional profile of the filter housing body 362 need not be circular, and can be a different shape, including an ellipse, an oval, a triangle, a rectangle, or a bean-shape. In an embodiment, the filter housing body 362 is made of a transparent or translucent material, allowing the user to observe filter element 365 that is housed inside the filter housing body 362. In an embodiment, the filter housing body 362 includes a transparent or translucent window that provides a view of the filter element 365. The filter element 365 is also a hollow cylinder made of a filter material. As shown by a dashed line in FIG. 3A, air flows from the tip 165 into the outer surface of the filter element 365. The air flows through the filter element 365 to the inner cavity of the filter element to toward the suction tube 115. This air flow through the filter element causes debris to be deposited on the outer surface of the filter element 365, making the debris visible to the user through the filter housing body 362 without the need to remove the filter element 365 from the vacuum wand 160. The filter element 365 can have a light color, such as white, when the element is new. This color will turn darker as debris collects in the filter element 365, giving the user visual indication of the need to replace the filter element 365.

The filter housing body 362 is detachably connected to filter housing end cap 380 via a similar or the same connection mechanism as the filter housing end cap 390. The filter housing end cap 380 includes a flange 374 that is movable into and out of the filter housing end cap 380 to provide a detachable connection to the mating connector 372. The mating connector 372 is connected to neck 363 that may be of a tubular shape, which terminates with connector 164. The neck 363 is elongate and has a length that is comfortably held by the user. The connector 164 has a connector tip 364 which accepts the tip 165.

Figure 3B:
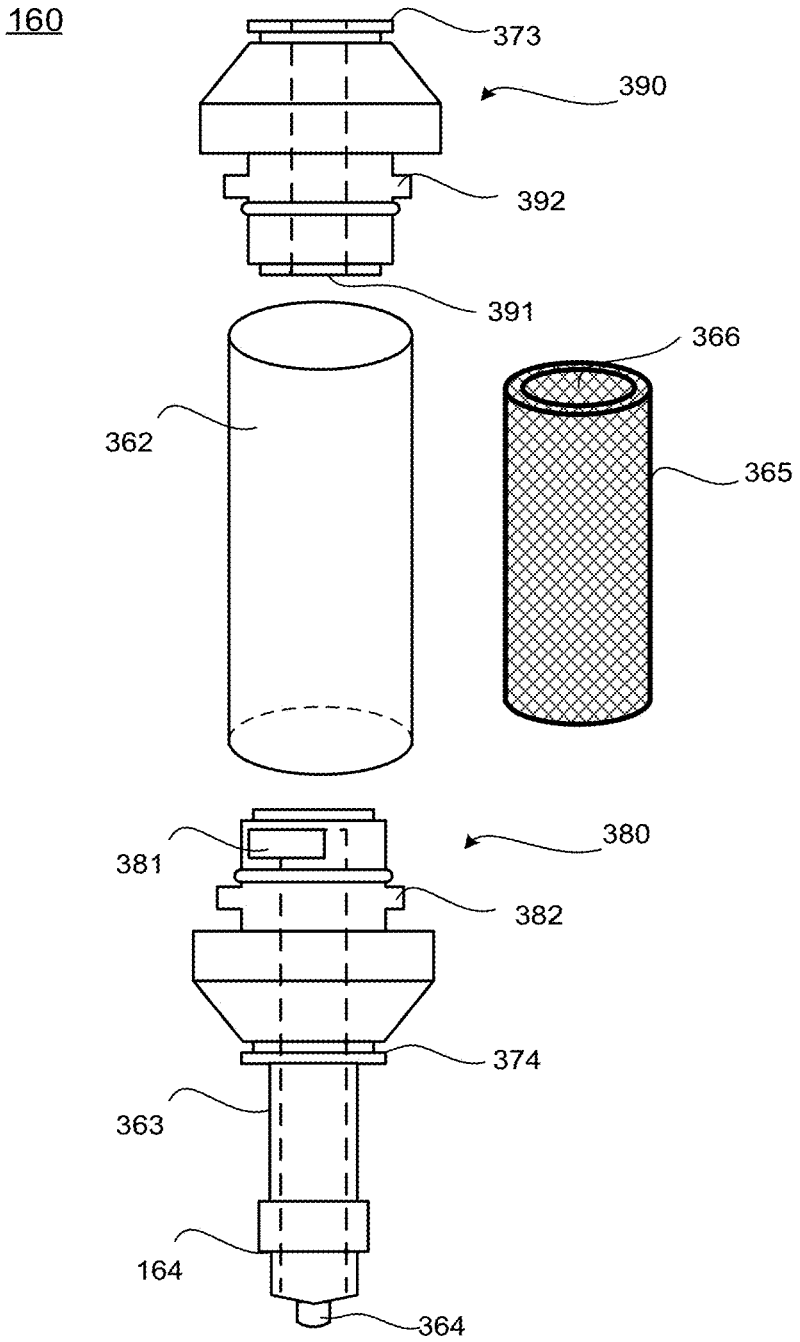

FIG. 3B illustrates an embodiment of the vacuum wand 160. The filter housing end cap 390 is shown with the flange 373, locking lugs 392, and an air passage 391. The dashed lines on the filter housing end cap 390 represent the passage of air. Air flows substantially straight through the filter housing end cap 390, from the flange 373 to the air passage 391. When the filter housing body 362 has the filter element 365 inside and is attached to the filter housing end cap 390, the air passage 391 aligns with the central cavity of the filter element 365.

The filter housing end cap 380 also includes locking lugs 382 for attachment to the filter housing body 362, but also includes an air passage 381 which is positioned on an outer radial surface of the filter housing end cap 380. The path of airflow through the filter housing end cap 380 is illustrated by dashed lines from the connector tip 364. As shown in FIG. 3B, the airflow does not reach the central cavity of the filter element 365, but instead passes through the air passage 381 and passes into a space created between the filter housing body 362 and the filter element 365 when the filter is assembled. This airflow passage supplies air carrying debris to the outer surface of the filter element 365. The air passes through the filter element 365 to reach the central cavity 366 of the filter element 365, and from there into the air passage 391 of the filter housing end cap 390.

Figure 4A:
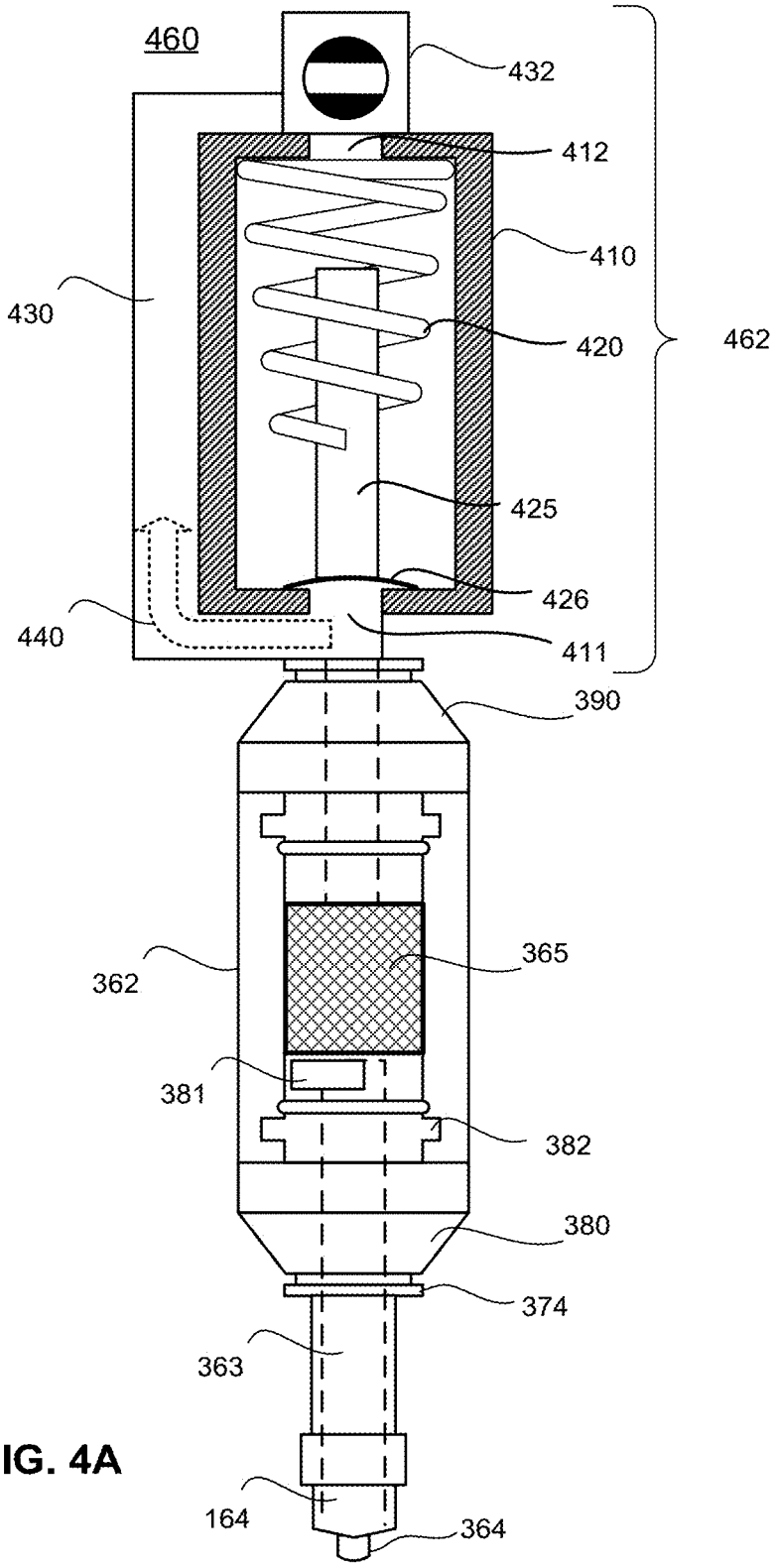
FIGS. 4A and 4B illustrate an embodiment of a vacuum wand with pulsating vacuum suction.
Figure 4B:
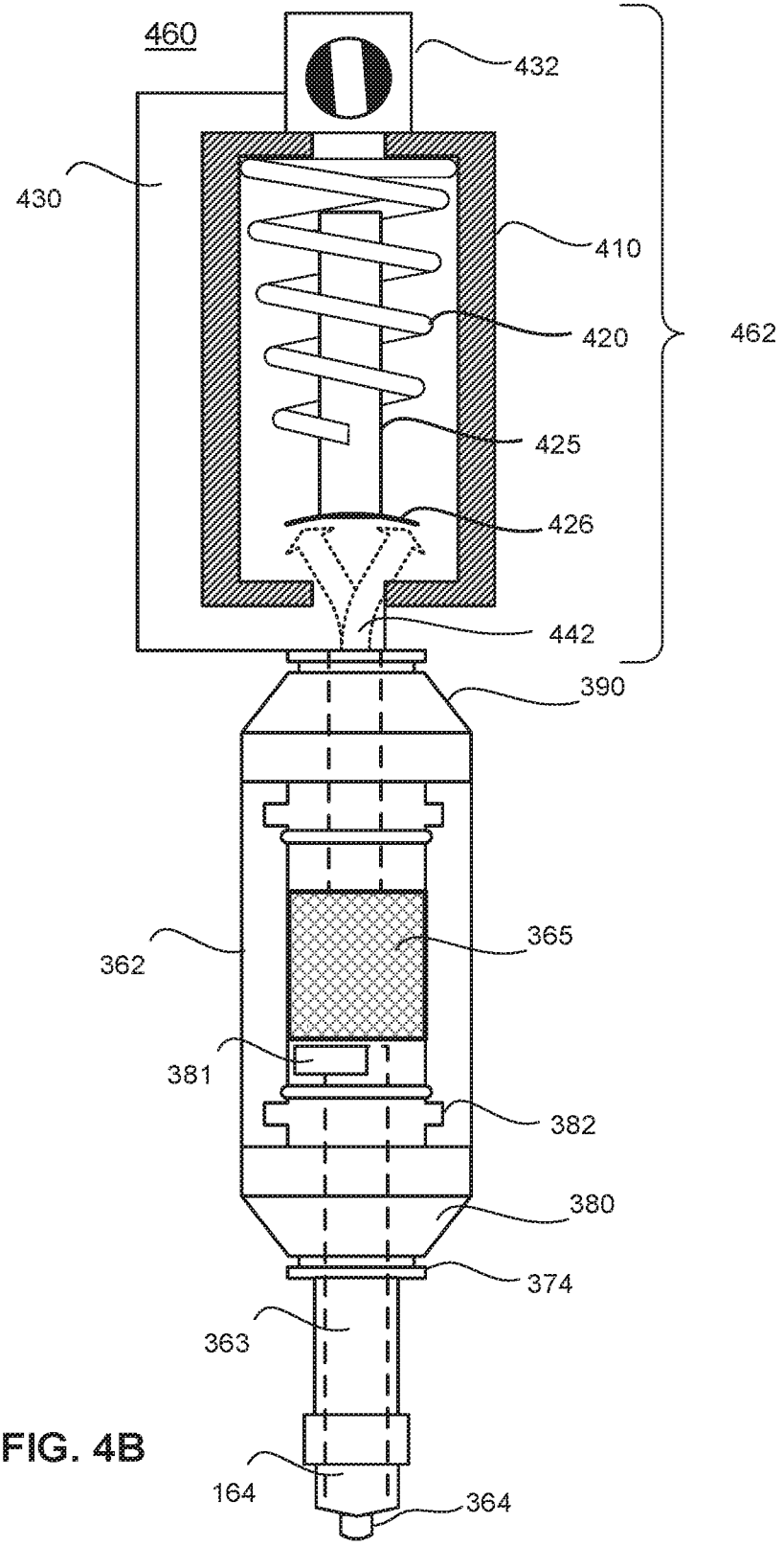

Referring to FIGS. 4A and 4B, an embodiment of a pulsating vacuum wand 460 provides pulsating vacuum functionality without the electronic valve 271 or the pulse mode switch 272. The pulsating vacuum wand 460 includes some elements described above in FIGS. 3A and 3B, and those elements are not described again. The pulsating vacuum wand 460 includes a pulsating element 462 which includes a number of sub-parts illustrated in FIG. 4A. The pulsating element 462 can be integrally built into the pulsating vacuum wand 460, or it can be a separate component that connects to the vacuum wand 160. The pulsating element 462 includes a pulsating control valve 432. In an embodiment, the pulsating control valve 432 is a manually operated pneumatic valve with in input port and at least two output ports. Operating the pulsating control valve 432 toggles a fluid connection from the input port to one or the other of the two output ports.

One of the output ports is fluidly connected to a bypass port 430. When the bypass port 430 is selected, the pulsating vacuum wand 460 operates at a continuous suction without pulsation. A stream of air 440 flows through the bypass port 430, but not through a pulsation chamber 410.

The pulsating vacuum wand 460 also includes a pulsation chamber 410. The pulsation chamber 410 is a hollow chamber with an inlet port 411 and an outlet port 412. The outlet port 412 is selectively connected by the pulsating control valve 432. When the outlet port 412 is connected, suction is applied to the outlet port 412 by a fluid connection to the pump 220. At the same time, the bypass port 430 is disconnected.

When suction is applied to the outlet port 412, vacuum builds up in the pulsation chamber 410 because the inlet port 411 is blocked by piston head 426. The piston head 426 can be flat, curved, rigid, or made of a flexible material. The piston head 426 is connected to a piston rod 425, which biased by a biasing element, such as a spring 420, toward the inlet port 411. Though the biasing element is illustrated as a spring 420, other devices that provide biasing force, such as an elastic band(s), an inflated elastic bladder(s), magnets with opposing polarity, or an electromagnetic coil surrounding a conductive member can be used to provide biasing force on the piston head 426.

The spring 420 has a spring constant k that determines the amount of biasing force exerted by the spring on the piston rod 425 and through it on the piston head 426. When the vacuum in the pulsation chamber 410 is sufficiently strong, it overcomes the biasing force of the spring 420 and pulls back the piston head 426, thus opening the inlet port 411, as shown in FIG. 4B.

When the inlet port 411 is opened, air flow 442 flows into the pulsation chamber 410, and suction from the pulsation chamber 410 is applied to the filter in pulsating vacuum wand 460, and through the filter to the connector tip 364.

The opening of the inlet port 411 reduces the vacuum in the pulsation chamber 410 until the biasing force of the spring 420 again closes the inlet port 411. This causes the vacuum to again build up, repeating the process disclosed above. The frequency of the pulsation is adjusted by adjusting the spring constant of the spring 420.

Figure 5:
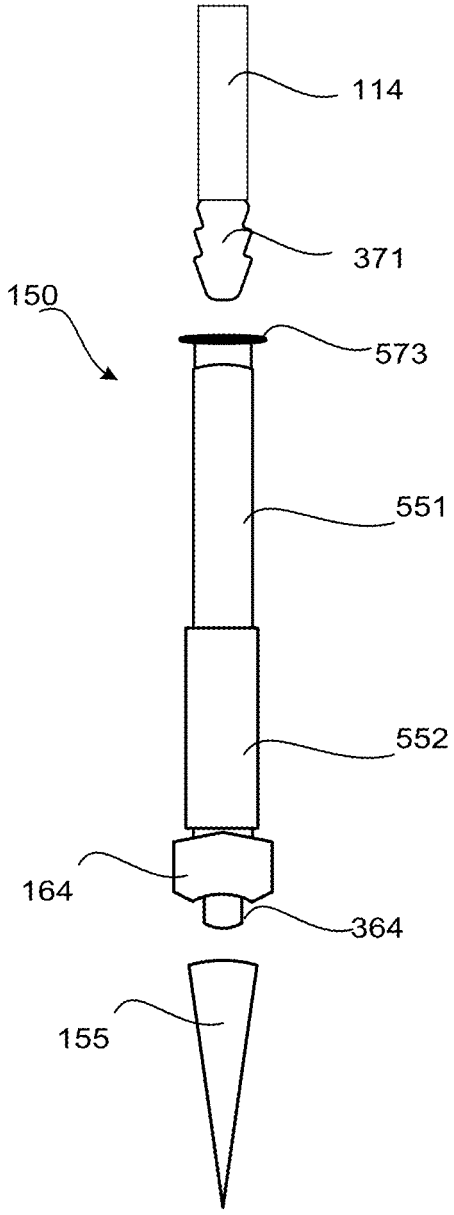
FIG. 5 illustrates a pressure wand according to an embodiment of the disclosure.

Referring to FIG. 5, a pressure wand 150 according to an embodiment is shown. The pressure wand 150 has an elongate tubular body 551 that may include a cushioned grip 552. The elongate tubular body 551 is hollow and is terminated with a flange 573 on one end and a connector 164 on the other end. The flange 573 provides a detachable connection to the mating connector 371 of the pressure tube 114. A tip 155 is connected to the connector tip 364. Different sizes of tips can be used to provide an airstream of different speeds.

Figure 8:
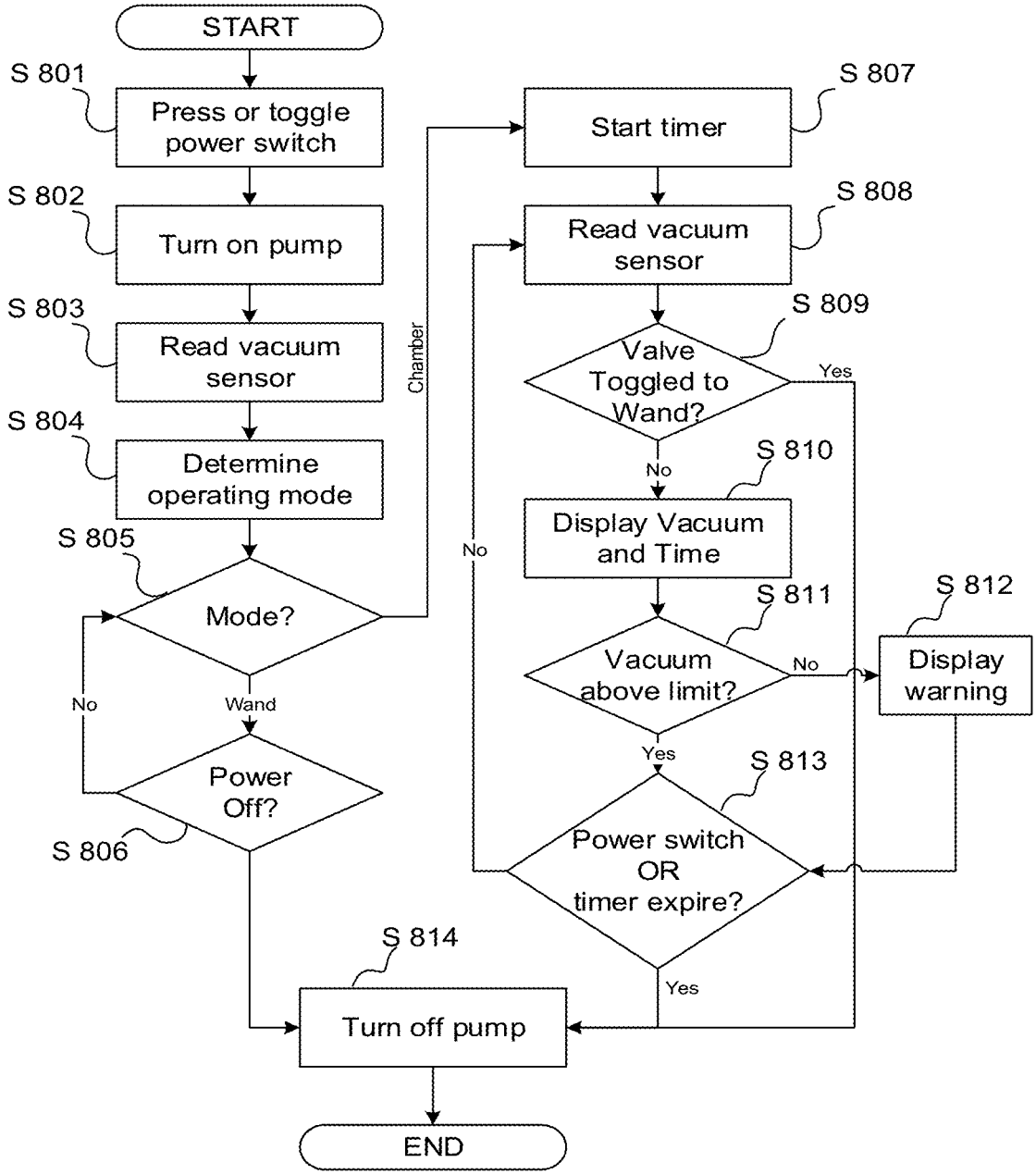
FIG. 8 illustrates a process flow executed in the controller of an exemplary embodiment.

Referring to FIG. 8, a process flow of an exemplary embodiment of the restoration system 100 is illustrated. At step S 801, the power switch 141 is turned on or toggled. The controller 210 detects this event as a power on event by polling the state of the power switch 141 or by turning on in response to receiving power. Subsequently, in step S 802, the pump 220 is powered on, outputting air through its pump outlet port 222 and sucking in air through its pump inlet port 221. At this stage, the controller 210 might not yet be aware of which mode ("wand" or "chamber") is selected by the pneumatic valve 142. The controller 210 will determine the mode by reading the output of the vacuum sensor 230 in step S 803.

As explained above, it is possible to determine the state of the pneumatic valve 142 (i.e., what mode is selected) based on the pressure or vacuum reading from the vacuum sensor 230. For example, if the there is no vacuum detected (i.e., the vacuum level is a constant zero), the pneumatic valve 142 is determined to be in the "wand" mode. When the pneumatic valve 142 is in the vacuum wand mode, the suction of the pump 220 is fluidly connected to the vacuum wand 160, but not to the fluid path connected to the vacuum chamber port 117 which is where the vacuum sensor 230 takes its measurement. Thus, the vacuum reading in a space fluidly connected to the vacuum chamber port 117 will be read as zero vacuum.

On the other hand, if the signal from the vacuum sensor 230 indicates the presence of vacuum at a constant positive level, a rising level, or a fluctuating level, the pneumatic valve 142 is determined to be in the "chamber" mode. Thus, at step S 805 the process branches based on which mode is determined.

If the pneumatic valve 142 is in the "wand" mode, the pump operates continuously until the power switch 141 is switched off, as detected in step S 806. Then, the pump turns off at step S 814.

If the pneumatic valve 142 is in the "chamber" mode, the controller 210 starts a timer, as described above. The timer may also be a distinct hardware component separate from the controller 210. The controller 210 monitors the state of the timer as shown in the looping steps terminating with step S 813. Before the process gets to step S 813, the vacuum sensor 230 is read in step S 808, which is similar to step S 803 described above. Based on the reading from step S 808, the controller 210 of the restoration system 100 determines in step S 809 whether the pneumatic valve 142 has been toggled out of the "chamber" mode into the "wand," which would indicate the operator of the system may wish to lift the removable container 121 off from vacuum chamber pad 119. Thus, if it is determined that the pneumatic valve 142 has been toggled to "wand," the process continues to step S 814, where the pump is turned off.

If in step S 809 it is determined that the pneumatic valve 142 had not been toggled to "wand," the process continues with step S 810 which displays current conditions about the operation of the system. In an exemplary embodiment, the vacuum level measured by the vacuum sensor 230 may be displayed. In other exemplary embodiments, the vacuum level measurement is filtered with a floor or ceiling function to filter out minor fluctuations in the reading. In other exemplary embodiments, the timer is displayed on the display 145, informing the operator of the remaining time in the cleaning cycle when operating in the chamber mode.

In other exemplary embodiments, the process may check in step S 811 whether the measured vacuum is above a predetermined level. This could be advantageous to detect leaks that do not completely deplete the vacuum, but leaks that may persist over time and would not be apparent without the measurement. If the vacuum (i.e., the value of the vacuum measurement) is above a limit value, the system is considered to be operating properly, and the process flow continues to step S 813. On the other hand, if the vacuum is not above the limit value, a warning is displayed to the user in step S 812.

After the warning, the process continues in step S 813, where a determination is made whether the power switch has been pressed or toggled, or whether the timer has expired. If the answer to either of these questions is yes, the process continues to step S 814, where the pump is turned off and the process terminates.

Features of the disclosed embodiments may be combined, rearranged, omitted, etc., within the scope of the disclosed subject matter to produce additional embodiments. Furthermore, certain features may sometimes be used to advantage without a corresponding use of other features. It is, thus, apparent that there is provided, in accordance with the present disclosure, a hearing device restoration system and associated manufactures, components, systems, and methods of use. Many alternatives, modifications, and variations are enabled by the present disclosure. While specific embodiments have been shown and described in detail to illustrate the application of the principles of the disclosure, it will be understood that the disclosed subject matter may be embodied otherwise without departing from such principles. Accordingly, Applicants intend to embrace all such alternatives, modifications, equivalents, and variations that are within the spirit and scope of the present disclosure.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

The invention claimed is:

1. A hearing aid restoration apparatus, comprising:

a housing with at least a first pneumatic port that selectively outputs air and a second pneumatic port that selectively sucks in air;

a user interface that receives a user input to select a mode of operation of the hearing aid restoration apparatus, a first mode of operation providing no suction at the second pneumatic port and a second mode of operation providing suction at the second pneumatic port; and a controller that detects whether the first mode of operation providing no suction at the second pneumatic port or the second mode of operation providing suction at the second pneumatic port is selected based on a measurement of vacuum inside the hearing aid restoration apparatus, a vacuum sensor that measures the level of vacuum in an air space that is not fluidly connected to the second pneumatic port and outputs a signal representative of the measured level of vacuum to the controller, where the vacuum sensor measures the level of vacuum as a positive vacuum pressure, a pneumatic valve that includes at least an input port, a first output port, and a second output port; and a pump that includes a pump inlet port and a pump outlet port, wherein the first output port is configured to provide a vacuum chamber mode and the second output port is configured to provide a vacuum wand mode, the input port of the valve is fluidly connected to the pump inlet port, the second output port of the pneumatic valve is fluidly connected to the second pneumatic port, the pneumatic valve comprises a toggle of the user interface, which toggle toggles a fluid connection from the input port of the pneumatic valve to either the first output port or the second output port, the vacuum sensor is arranged upstream of the first output port, and the vacuum sensor outputs a signal representative of the measured level of vacuum in said air space to the controller.

2. The hearing aid restoration apparatus according to claim 1, further comprising:

a fluid connection between the first output port of the pneumatic valve and a vacuum chamber port of the hearing aid restoration apparatus, wherein the vacuum sensor measures the level of vacuum in said fluid connection.

3. The hearing aid restoration apparatus according to claim 2, further comprising:

a pad located on an outer surface of the housing; and a removable container forming an airtight seal when placed on the pad, wherein the vacuum chamber port is located at least partially in the pad.

4. The hearing aid restoration apparatus according to claim 1, wherein the user interface is configured as a toggle switch protruding from the housing, the toggle switch being movable between a first position corresponding to the first mode and a second position corresponding to the second mode, and the toggle switch controls an internal flow path of the pneumatic valve.

5. The hearing aid restoration apparatus according to claim 1, further comprising:

a vacuum cleaning wand fluidly connected to the second pneumatic port, the vacuum cleaning wand including a filter element, a tubular neck extending from the filter element, and a tip attached to an end of the tubular neck.

6. The hearing aid restoration apparatus according to claim 1, further comprising:

a retracting mechanism that extends and retracts a tube, the tube passing through the second pneumatic port, the retracting mechanism at least partially spooling said tube inside the housing.

7. The hearing aid restoration apparatus according to claim 2, wherein the controller determines that the hearing aid restoration apparatus is in the second mode based on the vacuum sensor signal value being continuously at or below a predetermined threshold, and the controller determines that the hearing aid restoration apparatus is in the first mode based on the vacuum sensor signal value fluctuating or being continuously above a second predetermined threshold.

8. The hearing aid restoration apparatus according to claim 7, wherein the controller initiates a count-down timer when it determines that the restoration apparatus is in the first mode, and the controller turns off the pump at the expiration of the count-down timer.

9. The hearing aid restoration apparatus according to claim 7, wherein the controller outputs a message indicating an error condition on the display when the controller determines that the hearing aid restoration apparatus is in the first mode and the fluctuating vacuum sensor signal remains below a third predetermined threshold.

10. The hearing aid restoration apparatus according to claim 7, wherein the controller applies a ceiling function or a floor function to the vacuum sensor signal and outputs a vacuum reading filtered by the ceiling function or the floor function on the display.

11. A method of restoring a hearing aid, the method comprising:

providing a hearing aid restoration apparatus comprising:

a housing with at least a first pneumatic port that selectively outputs air and a second pneumatic port that selectively sucks in air;

a user interface that receives a user input to select a mode of operation of the hearing aid restoration apparatus, a first mode of operation providing no suction at the second pneumatic port and a second mode of operation providing suction at the second pneumatic port; and a controller that detects whether the first mode of operation providing no suction at the second pneumatic port or the second mode of operation providing suction at the second pneumatic port is selected based on a measurement of vacuum inside the hearing aid restoration apparatus, a vacuum sensor that measures the level of vacuum in an air space that is not fluidly connected to the second pneumatic port and outputs a signal representative of the measured level of vacuum to the controller, where the vacuum sensor measures the level of vacuum as a positive vacuum pressure, a pneumatic valve that includes at least an input port, a first output port, and a second output port; and a pump that includes a pump inlet port and a pump outlet port, wherein the first output port is configured to provide a vacuum chamber mode and the second output port is configured to provide a vacuum wand mode, the input port of the valve is fluidly connected to the pump inlet port, the second output port of the pneumatic valve is fluidly connected to the second pneumatic port, the pneumatic valve comprises a toggle of the user interface, which toggle toggles a fluid connection from the input port of the pneumatic valve to either the first output port or the second output port, the vacuum sensor is arranged upstream of the first output port, and the vacuum sensor outputs a signal representative of the measured level of vacuum in said air space to the controller;

using the hearing aid restoration apparatus to:

detect by a controller whether a power switch of a hearing aid restoration apparatus has been activated;

supply electrical power to a pump in response to the power switch being activated;

measure a vacuum level in volume fluidly connected to a vacuum chamber with a vacuum sensor of the hearing aid restoration apparatus;

determine that the hearing aid restoration apparatus is in a vacuum chamber mode when the measured vacuum level fluctuates or exceeds a predetermined threshold; and activate a timer in response to the determination that the hearing aid restoration apparatus is in the vacuum chamber mode.

12. The method according to claim 11, further comprising:

monitoring the power switch; and shutting off power to the pump when the power switch is turned off.

13. The method according to claim 12, further comprising:

determining by the controller that the hearing aid restoration apparatus has been switched to a vacuum wand mode when the measured vacuum level drops below a second predetermined threshold after the determination that the hearing aid restoration apparatus is in the vacuum chamber mode and the pump is operating.

14. The method according to claim 11, further comprising:

displaying a message indicating an error condition on a display of the hearing aid restoration device in response to a measurement of the vacuum level below a third predetermined threshold when the hearing aid restoration apparatus is in the vacuum chamber mode.

* * * * *